US005943796A

United States Patent [19]

Hedstrom

[11] Patent Number: 5,943,796

[45] Date of Patent: Aug. 31, 1999

[54] ROOF SNOW REMOVAL DEVICE

[76] Inventor: Arthur C. Hedstrom, 18 Spring Farm La., St. Paul, Minn. 55127

[21] Appl. No.: 09/076,241

[22] Filed: May 12, 1998

[51] Int. Cl.[6] ..... E01H 5/02

[52] U.S. Cl. ..... 37/285; 294/54.5

[58] Field of Search ..... 294/19.1, 49, 51, 294/53.5, 54.5, 59; 15/236.01; 37/241, 265, 266, 268, 270, 284, 285; D8/7, 10, 14

[56] References Cited

U.S. PATENT DOCUMENTS

| | | | |
|---|---|---|---|
| 2,710,465 | 6/1955 | Timerson | 294/54.5 X |
| 3,483,643 | 12/1969 | Wenzel | 294/54.5 X |
| 3,998,486 | 12/1976 | Mittelstadt . | |
| 4,067,107 | 1/1978 | Scafetta . | |
| 4,089,127 | 5/1978 | Maijala | 37/268 |
| 4,185,403 | 1/1980 | Hardgrove | 37/265 |
| 4,249,767 | 2/1981 | Andreasen . | |
| 4,253,257 | 3/1981 | Albert | 37/265 X |
| 4,729,199 | 3/1988 | Oller . | |
| 5,067,197 | 11/1991 | Cormier . | |
| 5,083,388 | 1/1992 | Cooley . | |
| 5,465,510 | 11/1995 | Goodnough et al. . | |
| 5,524,369 | 6/1996 | Phillips | 294/54.5 X |
| 5,570,524 | 11/1996 | Groat . | |
| 5,791,707 | 8/1998 | Szakurski | 294/54.5 |

OTHER PUBLICATIONS

"Roof Rake makes Clearing Snow Safe and Easy!", Harriet Carter, North Wales, PA, 1996.

"Angled Telescoping Pole makes It Even Easier To Get Damaging Snow Off Your Roof–'Rake' It Off!", Improvements, Hanover, PA, Winter 1997.

Brookstone Hard–To–Find Tools, Aluminum Snow Rake, 60" Handle Extension and "No Lift Snow Scoop".

Garelick, Roof Snow Rake With New "Shingle Saver" Blade, Garelick Mfg. Co., Form #60.

Zak, Swivel 3 Way Snow Remover, Zak's Snow Removal System, Oct. 1996.

Avalanche!® Snow Remover, Model 280, Internet Information.

*Primary Examiner*—Johnny D. Cherry

[57] ABSTRACT

A device (10) for removing snow from roofs and similar surfaces includes an elongated flexible sheet (26) having its leading edge attached to a flat plate (22) of a blade (20) such as by being sandwiched against the flat plate (22) by a clamping plate (40) secured to the flat plate (22) by bolts (24). The blade (20) is U-shaped and includes leg plates (38) extending from the opposite side edges of the flat plate (22). The blade (20) is pivotably mounted to the leg plates (32) of a U-shaped frame (11) by bolts (18) extending through the leg plates (38, 32) of the blade (20) and the frame (11). The leg plates (32) of the frame (11) extend from the opposite side edges of a top plate (16). A tubular support member (12) secured to the top plate (16) slideably receives the free end of a pole (42). When moved relative to the roof or similar surface, the blade (20) slices the snow, and the flexible sheet (26) is pulled into the sliced opening. The snow easily slides on the flexible sheet (26) and falls off the roof or similar surface.

20 Claims, 2 Drawing Sheets

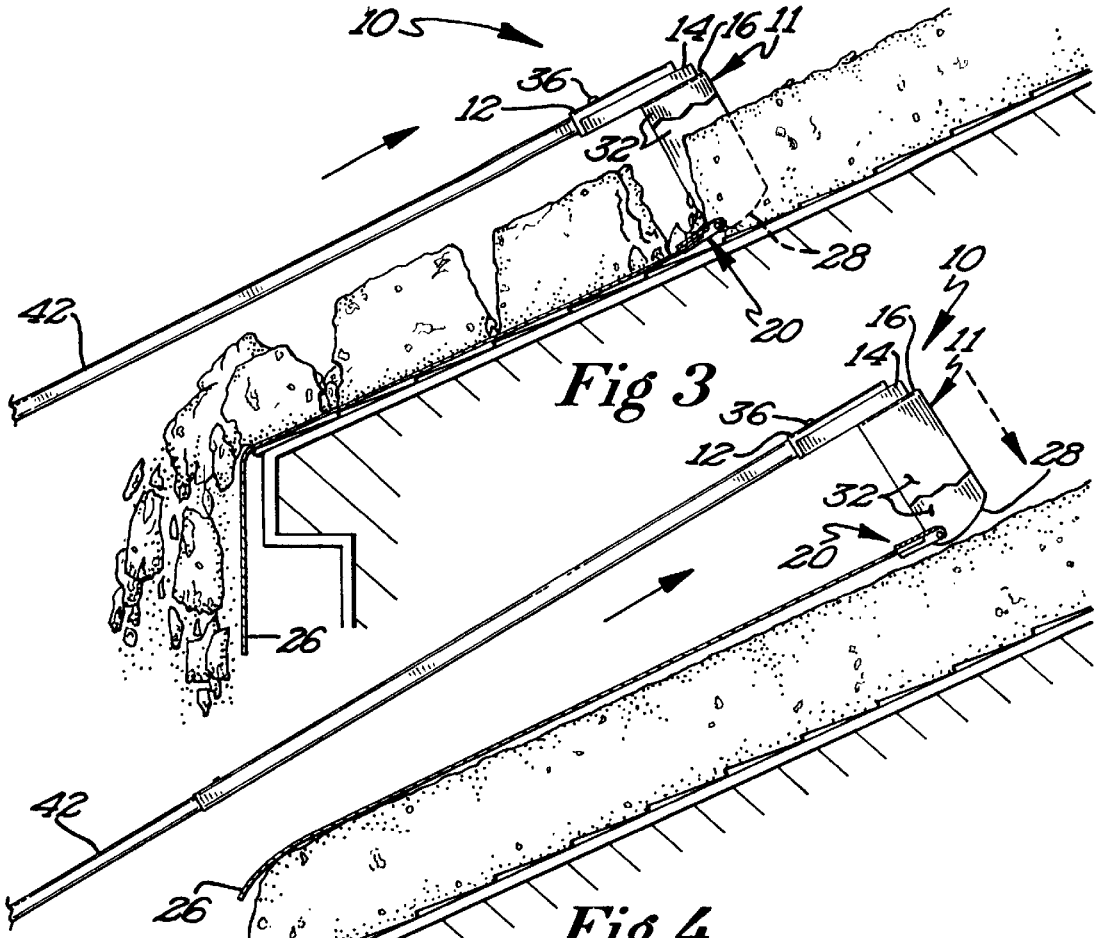
Fig 3
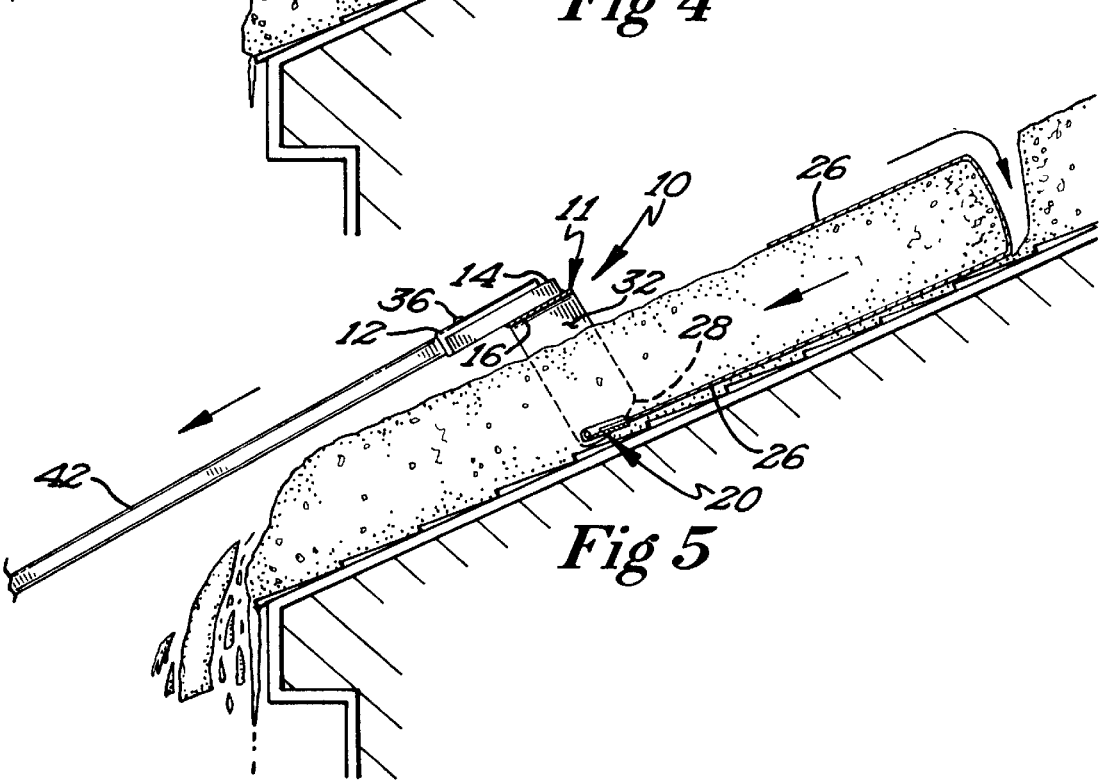
Fig 4
Fig 5

ROOF SNOW REMOVAL DEVICE

BACKGROUND

The present invention generally relates to devices used to remove snow from the roofs of houses and other tall buildings and similar surfaces and especially from pitched or inclined roofs and like surfaces.

The build-up of snow on roofs can cause serious problems if melting occurs creating ice dams causing water to back up under shingles and leak through the roof into the house or other building. Also, if the weight of the snow becomes too heavy for the roof to support, caving in of the roof from the weight of snow and water accumulated on the roof can result in dumping snow and water into the house or like building. Thus, not only must the roof itself be repaired, but anything in the interior of the house or like building that acquired water damage must be replaced or repaired. Additionally, this is often a problem which can occur annually.

One solution to snow build-up is to remove snow off the roofs of houses and like buildings. A common method of snow removal is shoveling which creates a risk of slipping and falling and places undue strain on the back of the shoveler. Additionally, shovels can only remove a certain amount of snow at a time causing the person shoveling to be subjected to the cold for a longer time than is necessary. Also, shoveling can damage the roof from the shovel being forcefully pushed into the shingles in attempts to remove the bottom layer of snow from the roof.

Other methods such as raking the snow off roofs can cause the snow to fall on top of the person trying to remove the snow and limits the ability to reach the highest or middle part of the roof if the handle is too short. Unless the person using prior rakes climbed onto the roof, which makes accidents more likely, the amount of snow that would get removed would be minimal. Additionally, rakes could pull shingles from the roof or otherwise damage them when the rake is dragged across them.

Other prior snow removal devices use a flexible sheet wrapped around a rod of a U-shaped frame that is pushed or pulled by an attachment across the roof breaking through the snow and causing it to slide down the flexible sheet. While avoiding many of the deficiencies encountered by shovels and snow roof rakes, the problem with such prior snow removal devices is that the flexible sheet that is wrapped around the rod is forced into the snow unprotected and is likely to rip and therefor frequently is in need of repair. Also, if snow is hardened, pushing the looped sheet and rod through the snow could prove to be quite difficult.

Thus, a need continues to exist for devices for removing snow from roofs and like surfaces which overcome the deficiencies experienced by prior snow removal techniques and which makes this task quicker, easier and safer.

SUMMARY

The present invention solves this need and other problems in the field of removing snow from roofs and other surfaces by providing, in the preferred form, an elongated flexible sheet having its leading edge attached to a flat plate of a blade pivotably mounted to first and second legs of a U-shaped frame to which an elongated pole is secured. Thus, the blade slices the snow, and the flexible sheet is pulled into the sliced opening with the snow easily sliding on the sheet and falling off the roof.

It is thus an object of the present invention to provide a novel device for removing snow from roofs and similar surfaces.

It is further an object of the present invention to provide such a novel snow removal device which is both useful and feasible.

It is further an object of the present invention to provide such a novel snow removal device utilizing a flexible sheet which is inserted under the snow which then slides thereon.

It is further an object of the present invention to provide such a novel snow removal device utilizing a flexible sheet which does not require gluing, adhering or similar connection.

It is further an object of the present invention to provide such a novel snow removal device utilizing a flexible sheet which is generally not subject to undue wear during insertion into snow.

It is further an object of the present invention to provide such a novel snow removal device which allows snow removal without requiring the user to climb onto the roof or like surface.

It is further an object of the present invention to provide such a novel snow removal device allowing minimization of the chance of snow falling from the roof or like surface onto a user located below the roof or surface.

It is further an object of the present invention to provide such a novel snow removal device which makes snow removal quicker, easier and safer.

It is further an object of the present invention to provide such a novel snow removal device which can be easily and inexpensively manufactured from stock materials.

It is further an object of the present invention to provide such a novel snow removal device which is able to cut through snow including a crust and located on roofs and like surfaces.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where:

FIGS. 3–5 show diagrammatic side views of the snow removal device of FIG. 1 in use on a roof and illustrating modes of operation of the snow removal device of FIG. 1.

Figure 1:
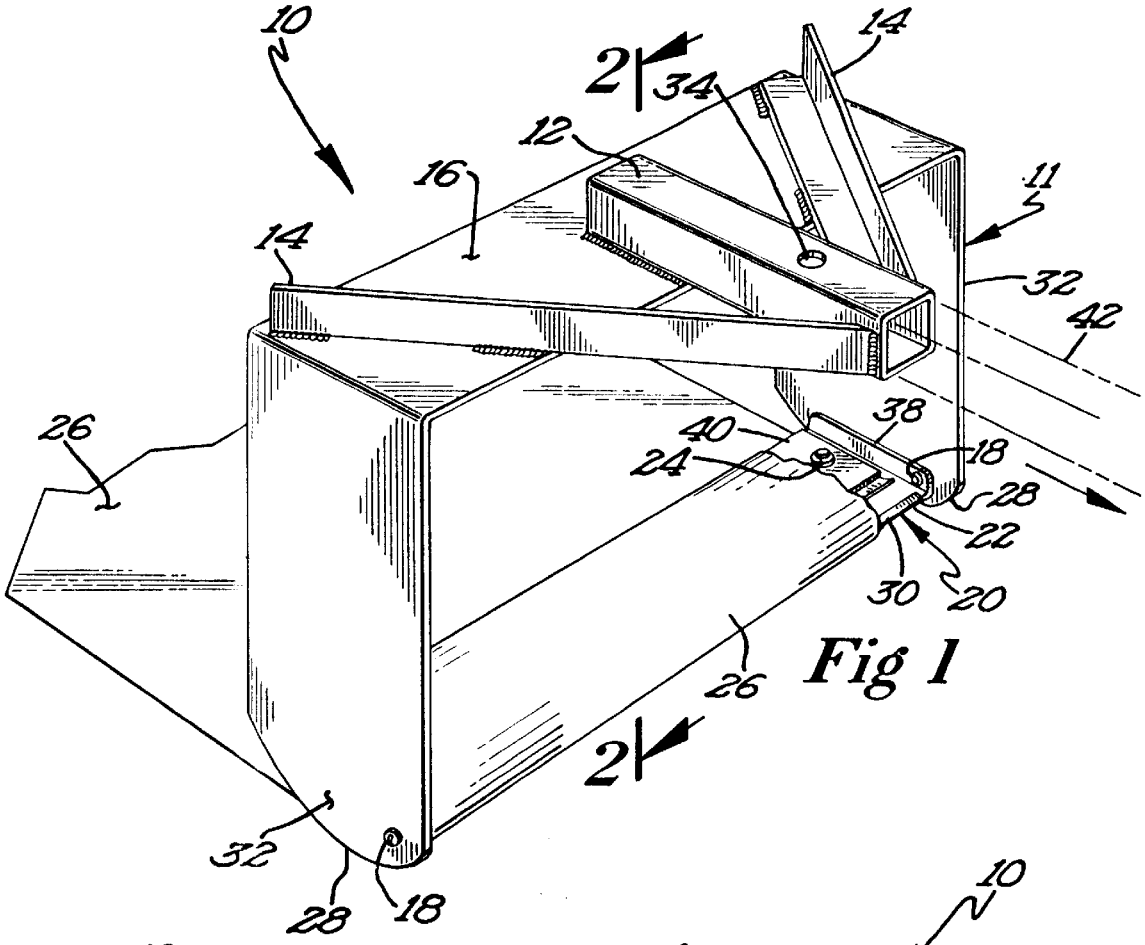
FIG. 1 shows a perspective view of a snow removal device according to the preferred teachings of the present invention, with the flexible sheet being partially wrapped around the blade for storage and transport, with portions broken away and shown in phantom.
Figure 2:
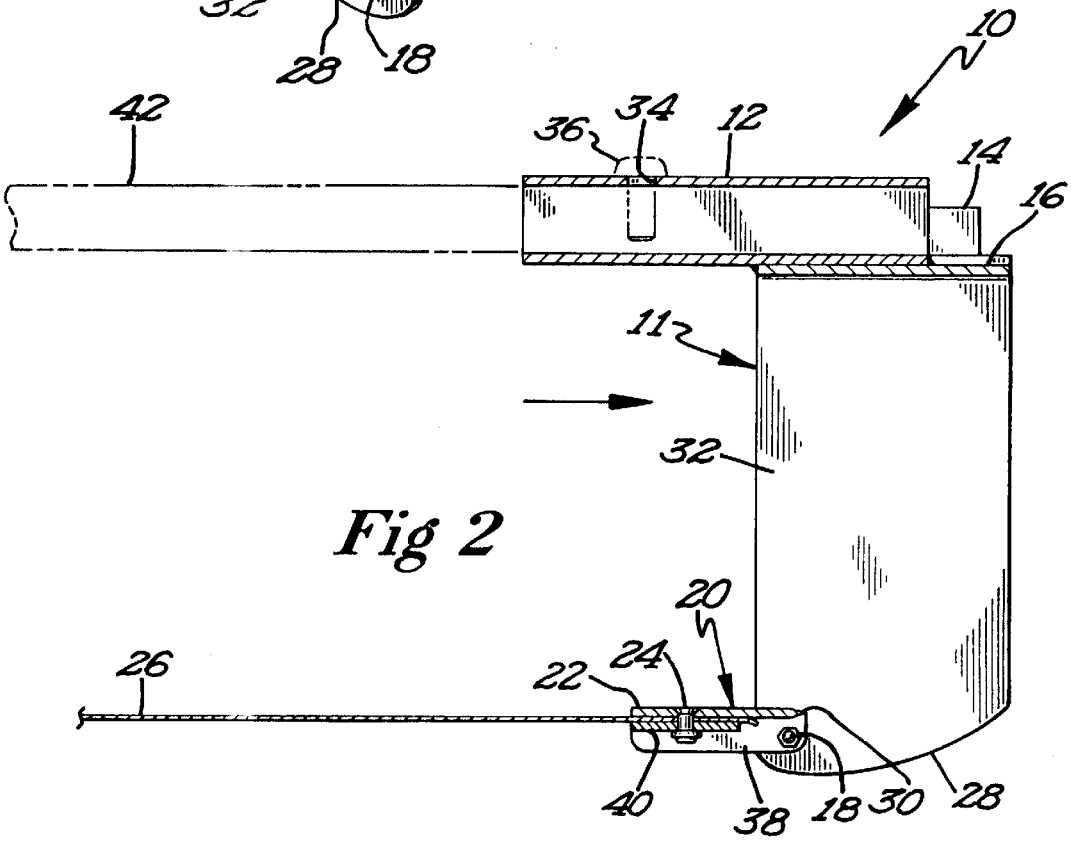
FIG. 2 shows a cross sectional view of the snow removal device of FIG. 1 according to section line 2—2 of FIG. 1, with the flexible sheet being unwrapped from the blade and extending generally parallel to the pole for ease of illustration, with portions broken away and shown in phantom.

All figures are drawn for ease of explanation of the basic teachings of the present invention only; the extensions of the figures with respect to number, position, relationship, and dimensions of the parts to form the preferred embodiment will be explained or will be within the skill of the art after the following description has been read and understood. Further, the exact dimensions and dimensional proportions to conform to specific force, weight, strength, and similar requirements will likewise be within the skill of the art after the following description has been read and understood.

Where used in the various figures of the drawings, the same numerals designate the same or similar parts. Furthermore, when the terms "top", "first", "second", "front","back", "upper", "lower", "height", "width", "length", "thickness", "end", "side", "trailing", "leading", and similar terms are used herein, it should be understood that these terms have reference only to the structure shown in the drawings as it would appear to a person viewing the drawings and are utilized only to facilitate describing the illustrative embodiment.

DESCRIPTION

A device for removing snow from pitched roofs and like surfaces according to the preferred teachings of the present invention is shown in the drawings and generally designated 10. Snow removal device 10 generally includes a U-shaped frame 11 including a flat top plate 16 having first and second flat leg plates 32 extending generally perpendicularly from the opposite side edges of top plate 16. The lower, free edge 28 of each first and second leg plates 32 is arcuate in shape from the front edge to the back edge to form runners for easy gliding on roof surfaces such as over shingles without damaging the roof surface. In the preferred form, plates 16 and 32 have generally equal widths from their front to back edges, and first and second leg plates 32 from their lower edges 28 to their upper edges connected to the side edges of top plate 16 have equal lengths. The thickness of plates 32 is minimal relative to their widths for ease of insertion into snow.

Snow removal device 10 further includes suitable provisions for removably securing an elongated shaft or pole 42 to U-shaped frame 11. In the most preferred form shown, pole 42 is tubular and is formed of a plurality of members having friction and slip fit ends. However, pole 42 can be formed in any desired manner including a single, unitary member. In the most preferred form shown, the removably securing provisions include a tubular support member 12 for slideably receiving a free end of pole 42. Support member 12 includes suitable provisions for preventing the undesired removal of pole 42 therefrom such as a hole 34 for receipt of a bolt, screw or similar fastener 36 between support member 12 and pole 42. Support member 12 is suitably secured to top plate 16 intermediate and parallel to the side edges of top plate 16 such as by welding, with support member 12 extending from a point intermediate the front and back edges of top plate 16 to a point located beyond the front edge of top plate 16. First and second L-shaped braces 14 extend from the back corners of top plate 16 to the front edge of support member 14 and are suitably secured thereto such as by welding, with braces 14 ensuring sturdiness and better control for the user.

Snow removal device 10 according to the preferred teachings of the present invention further includes a U-shaped snow blade 20 including a flat plate 22 having first and second flat leg plates 38 extending generally perpendicular from the opposite side edges of flat plate 22. The leading edge 30 of plate 22 which creates an area for insertion into the snow is ground, sharpened or otherwise suitably shaped into a cutting edge. The corners of the free edges of plates 38 are suitably rounded so as not to present a sharp corner. In the preferred form, plates 22 and 38 have generally equal widths from their leading edge 30 to their trailing edge which is less than the widths of plates 16 and 32. Also, the widths of plates 22 and 38 are substantially larger than the thickness of plates 22 and 38 for ease of insertion into snow. The lengths of first and second leg plates 38 from their free edges to plate 22 are equal and are minimal and in particular are substantially less than the lengths of plates 32 from their free edges 28 to plate 16. The length of plate 22 is generally equal to and for slideable receipt between plates 32.

Snow blade 20 is suitably pivotably mounted to first and second leg plates 32 of frame 11 such as by bolts 18 which define the pivot axis of snow blade 20. In the most preferred form, the axis defined by bolts 18 is located closely adjacent the front edges and lower edges 28 of plates 32 and adjacent the leading edges and free edges of plates 38. In this regard, closely adjacent means bordering or neighboring the identified edges in the sense of being substantially closer to the identified edges than to the other edges such as in a manner shown in the figures and in the preferred form and in the case of blade 32 being spaced from leading edges of plates 38 and of leading edge 30 in an amount only sufficient to allow leg plates 38 to provide structural support for bolts 18. It can be appreciated that suitable provisions can be utilized to reduce frictional forces between snow blade 20 and frame 11 such as but not limited to providing washers on bolts 18 between plates 32 and 38.

Snow removal device 10 according to the preferred teachings of the present invention further includes an elongated flexible sheet 26 formed of any thin, smooth, low surface friction material such as plastic allowing snow to slide easily over it. The leading edge of sheet 26 is suitably attached to flat plate 22 of snow blade 20 behind leading edge 30 and specifically without sheet 26 extending over leading edge 30 during snow removal. In the preferred form, the leading edge of sheet 26 is sandwiched between a clamping plate 40 and flat plate 22, with clamping plate 40 being removably secured to flat plate 22 such as by bolts 24 extending through flat plate 22, sheet 26, and clamping plate 40 as shown. The width of elongated sheet 26 is generally equal to the spacing between leg plates 38 of snow blade 20.

In the preferred form, device 10 (aside from sheet 26) is formed of aluminum to minimize weight while still providing the necessary strength for reducing the effort required during use. However, in the most preferred form, pole 42 is formed of nonconductive material such as fiberglass to prevent electrical shock in the event that device 10 should inadvertently contact electrical lines. Also, device 10 is formed by welding and/or stamping stock materials to reduce capital costs.

Now that the basic construction of snow removal device 10 has been explained according to the preferred teachings of the present invention, methods of use and some of the advantages obtained by device 10 can be set forth. When not in use, flexible sheet 26 can be wrapped around flat plate 22, and pole 42 can be removed from support member 12 (and pole 42 can be broken down into a plurality of pieces) for ease of transport and storage with minimal space requirements. In addition, there is less tendency of tearing of flexible sheet 26 during storage and transport in a wrapped condition on blade 20 than in an unwrapped condition. It should be appreciated that the fixation of the leading edge of sheet 26 and the substantial width of plate 22 relative to its thickness in allowing the wrapping of sheet 26 for storage is advantageous over other manners of attachment such as but not limited to passing a rod through a loop formed on the leading edge of the flexible sheet 26. It should further be appreciated that the rotatable mounting of snow blade 20 in frame 11 is also advantageous in allowing ease of the wrapping and unwrapping of flexible sheet 26 upon snow blade 20 without requiring moving of frame 11.

When it is desired to utilize device 10 to remove snow from a roof or similar surface, pole 42 is inserted into support member 12 and suitably secured therein such as by use of fasteners 36. Sheet 26 should be unwrapped from snow blade 20 before use.

FIG. 3 shows a first mode of use of device 10 according to the preferred teachings of the present invention where the user would stand at a point below the roof and the user utilizing pole 42 would position frame 11 adjacent to the eave or lower edge of the roof and the back edge of frame 11 is pushed up the roof away from the eaves or lower edge of the roof with edges 28 of leg plates 32 engaging the roof. It should then be appreciated that due to the weight of sheet 26 hanging therefrom and the positioning of the axis defined by bolts 18 in blade 20, blade 20 will pivot in U-shaped frame 11 such that leading edge 30 will be located intermediate the back and front edges of frame 11 and the trailing edge of blade 20 will be positioned behind the front edge of frame 11 and on the opposite side of the front edge than the back edge of frame 11. When the user pushes pole 42, edges 28 of frame 11 will generally ride upon the roof or similar surface and leading edge 30 of blade 20 will slice the snow slightly above the roof or similar surface. Flexible sheet 26 will be pulled by blade 20 into the sliced opening. The snow as it is being sliced will slide upon flat plate 22 and onto flexible sheet 26. Once upon flexible sheet 26, snow under gravitational forces will tend to separate and slide upon flexible sheet 26 and fall from the roof or similar surface.

FIGS. 4 and 5 show another mode of use of device 10 according to the preferred teachings of the present invention. Specifically, while the user stands at a point below the roof, the user positions lower edges 28 on the upper surface of the snow on the roof and moves frame 11 upon the snow as shown in FIG. 4. It should then be appreciated that due to the weight of sheet 26 hanging therefrom and the positioning of the axis defined by bolts 18 in blade 20, blade 20 will pivot in U-shaped frame 11 such that leading edge 30 will be located intermediate the back and front edges of frame 11 and the trailing edge of blade 20 will be positioned behind the front edge of frame 11 and on the opposite side of the front edge than the back edge of frame 11. When frame 11 is at the desired height or the maximum height permitted by the specific length of pole 42, pole 42 can be pulled downward toward the eave or lower edge of the roof. It should be appreciated that due to the change of movement direction, blade 20 will pivot in frame 11 and leading edge 30 will slice through the upper surface of the snow and will move towards the roof until edges 28 engage the roof preventing further downward movement. With further pulling of pole 42, edges 28 of frame 11 will generally ride upon the roof or similar surface and leading edge 30 of blade 20 will slice the snow slightly above the roof or similar surface. After being sliced, plate 22 and flexible sheet 26 will be pulled into the sliced opening between the roof and the snow as best in FIG. 5. As seen in FIG. 5, flexible sheet 26 will have a U-shape as it moves from above the top surface of the snow, through the snow, and adjacent to the roof or similar surface. As frame 11 approaches the lower edge of the roof, the mass of the snow below frame 11 will be insufficient to hold the mass of the snow located upon sheet 26 and will fall from the roof or similar surface, with the snow upon sheet 26 tending to easily slide from sheet 26 and falling off the roof or similar surface. It can then be appreciated that the snow will tend to stay on the roof or similar surface until frame 11 is relatively close to the lower edge of the roof and thus when the user at the opposite end of pole 42 is located at a spaced distance from the roof. Thus, the chance of snow falling off the roof and onto the user of device 10 is greatly reduced utilizing the mode of operation of FIGS. 4 and 5 than the mode of operation of FIG. 3 (especially when frame 11 is positioned at the maximum extent of pole 42).

It should be appreciated that snow removal device 10 can be utilized in other modes of operation according to the teachings of the present invention including but not limited to with the user positioned on or above the roof.

The use of a blade 20 including a flat plate 22 according to the teachings of the present invention is advantageous over prior snow removers having a rod passing through a loop formed on the leading edge of the flexible sheet. Specifically, leading edge 30 can be sharpened and creates a much smaller insertion area than the double thickness of flexible sheet and diameter of the rod of prior snow removers. A sharpened leading edge 30 can more readily cut through a crust formed on the upper surface of snow in the mode of operation of FIGS. 4 and 5. Additionally, wear of the leading edge of sheet 26 is reduced when sandwiched between plates 22 and 40 than when it is wrapped around a rod and forms the insertion area. Additionally, flexible sheet 26 according to the preferred teachings of the present invention does not require gluing, adhering, or similar connection as would be required when a loop is utilized. Thus, sheet 26 of device 10 can be formed from stock material and can be simply reattached to blade 20 in the event that the leading edge is torn off.

The pivotal mounting of blade 20 according to the teachings of the present invention is advantageous in allowing device 10 to be either pushed or pulled through the snow to allow the mode of operation of FIG. 3 or of FIGS. 4 and 5. In particular, leading edge 30 pivots to allow insertion through the upper surface of the snow and then to allow following the roof or similar surface as frame 11 is moved along the roof or similar surface. Additionally, the preferred positioning of the axis defined by bolts 18 is advantageous in moving blade 20 so that flat plate 22 is parallel to the roof or similar surface in operation and keeps leading edge 30 from attempting to dig into the roof or similar surface.

Formation of frame 11 from plates 16 and 32 having substantial widths relative to their thickness rather than tubular material as an example is advantageous for several reasons. First, frame 11 according to the preferred teachings of the present invention has increased strength. Additionally, the substantial widths of plates 32 allow providing arcuate edges 28 which can be utilized as elongated runners on the roof or similar surface in preventing damage to the roof or similar surface such as to shingles on the roof. In fact, device 10 of the most preferred form of the present invention has been successfully utilized on shake roofs.

Now that the basic teachings of the present invention have been explained, many extensions and variations will be obvious to one having ordinary skill in the art. For example, although frame 11 in the most preferred form shown includes top 16 and legs 32 formed of plates and is believed to be advantageous, frame 11 could have other forms and shapes according to the teachings of the present invention. In this regard, frame 11 could be formed of tubular material of one or more pieces such as of the type shown in U.S. Pat. No. 3,998,486 or of the product actually commercialized under that patent. Similarly, frame 11 according to the teachings of the present invention could include wheels freely rotatable about the axis of snow blade 20 defined by bolts 18 in place of or in addition to elongated, arcuate, lower free edges 28 of legs 32 for rolling on roof surfaces such as over shingles without damaging the roof surface.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

I claim:

1. Device for removing snow from roofs and similar surfaces comprising, in combination: a frame having a U-shape including a top and first and second legs extending from the top; means for securing an elongated pole to the frame; a blade pivotably mounted to the first and second legs of the frame about an axis, with the blade including a flat plate having a length between the first and second legs, a width, and a thickness, with the width being substantially larger than the thickness; an elongated flexible sheet having a leading edge; and means for attaching the leading edge of the elongated flexible sheet to the flat plate of the blade.

2. The snow removal device of claim 1 wherein the flat plate of the blade includes a leading edge creating an area for insertion into the snow, with the attaching means attaching the leading edge of the elongated flexible sheet to the flat plate of the blade without the flexible sheet extending over the leading edge of the flat plate during snow removal.

3. The snow removal device of claim 2 wherein the attaching means comprises, in combination: a clamping plate; and means for removably securing the clamping plate to the flat plate with the leading edge of the flexible sheet sandwiched between the clamping plate and the flat plate.

4. The snow removal device of claim 1 wherein the flat plate of the blade includes a leading edge creating an area for insertion into the snow, with the axis of the blade located closely adjacent to the leading edge of the flat plate.

5. The snow removal device of claim 4 wherein the blade further includes first and second leg plates extending from the flat plate, with the blade having a U-shape, with the axis of the blade extending through the first and second leg plates.

6. The snow removal device of claim 5 wherein the first and second legs of the frame are formed from plates each having a front edge, a back edge, and a lower edge, with the width of the legs between the front edge and the back edge being greater than the width of the flat plate of the blade.

7. The snow removal device of claim 6 wherein the axis of the blade extends through the first and second legs adjacent to the front and lower edges of the plates forming the first and second legs.

8. The snow removal device of claim 7 wherein the lower edge of the plates forming the first and second legs of the frame are arcuate in shape from the front edges and back edges of the plates to define elongated runners for gliding on the roof and similar surface.

9. The snow removal device of claim 8 wherein the securing means removably secures the elongated pole to the frame.

10. The snow removal device of claim 9 wherein the securing means comprises a tubular support member for slideably receiving the pole.

11. The snow removal device of claim 10 wherein the top of the frame is formed from a plate having a width generally equal to the width of the plates forming the first and second legs, with the tubular support member being secured to the top of the frame; and wherein the snow removal device further comprises, in combination: braces secured to the top of the frame and to the tubular support member.

12. The snow removal device of claim 1 wherein the blade further includes first and second leg plates extending from the flat plate, with the blade having a U-shape, with the axis of the blade extending through the first and second leg plates.

13. The snow removal device of claim 12 wherein the axis of the blade extends through the first and second legs adjacent to the front and lower edges of the plates forming the first and second legs.

14. The snow removal device of claim 12 wherein the first and second legs of the frame are formed from plates each having a front edge, a back edge, and a lower edge, with the width of the legs between the front edge and the back edge being greater than the width of the flat plate of the blade.

15. The snow removal device of claim 14 wherein the lower edge of the plates forming the first and second legs of the frame are arcuate in shape from the front edges and back edges of the plates to define elongated runners for gliding on the roof and similar surface.

16. The snow removal device of claim 1 wherein the first and second legs of the frame are formed from plates each having a front edge, a back edge, and a lower edge; and wherein the lower edge of the plates forming the first and second legs of the frame are arcuate in shape from the front edges and back edges of the plates to define elongated runners for gliding on the roof and similar surface.

17. The snow removal device of claim 16 wherein the securing means comprises a tubular support member for slideably receiving the pole; wherein the top of the frame is formed from a plate having a width generally equal to the width of the plates forming the first and second legs, with the tubular support member being secured to the top of the frame; and wherein the snow removal device further comprises, in combination: braces secured to the top of the frame and to the tubular support member.

18. The snow removal device of claim 1 wherein the attaching means comprises, in combination: a clamping plate; and means for removably securing the clamping plate to the flat plate with the leading edge of the flexible sheet sandwiched between the clamping plate and the flat plate.

19. The snow removal device of claim 1 wherein the securing means removably secures the elongated pole to the frame.

20. The snow removal device of claim 19 wherein the securing means comprises a tubular support member for slideably receiving the pole; wherein the top of the frame is formed from a plate, with the tubular support member being secured to the top of the frame; and wherein the snow removal device further comprises, in combination: braces secured to the top of the frame and to the tubular support member.

* * * * *